US006202892B1

(12) United States Patent
Lasko

(10) Patent No.: US 6,202,892 B1
(45) Date of Patent: Mar. 20, 2001

(54) CONTROL SYSTEM FOR GLUE GUN

(76) Inventor: Bernard C. Lasko, 2605 Colonial Pkwy., Fort Worth, TX (US) 76109

( * ) Notice: Subject to any disclaimer, the term of this patent is extended or adjusted under 35 U.S.C. 154(b) by 0 days.

(21) Appl. No.: 09/419,050

(22) Filed: Oct. 15, 1999

Related U.S. Application Data

(60) Provisional application No. 60/104,365, filed on Oct. 15, 1998.

(51) Int. Cl.[7] ..... B67D 5/08

(52) U.S. Cl. ..... 222/54; 63/108; 63/146.5

(58) Field of Search ..... 222/54, 63, 109, 222/108, 146.5, 386, 391, 333

(56) References Cited

U.S. PATENT DOCUMENTS

| | | |
|---|---|---|
| 2,178,720 | 11/1939 | Daniels . |
| 2,226,446 | 12/1940 | Smith et al. . |
| 2,226,447 | 12/1940 | Smith et al. . |
| 2,556,609 | 6/1951 | Arkless . |
| 2,742,142 | 4/1956 | Paulsen . |
| 2,974,874 | 3/1961 | Raymond . |
| 3,238,346 | 3/1966 | Savko . |
| 3,485,417 | 12/1969 | Cocks . |
| 3,543,968 | 12/1970 | Reighard . |
| 3,620,289 | 11/1971 | Phipps, Jr. . |
| 3,744,921 | 7/1973 | Weller et al. . |
| 3,854,629 | 12/1974 | Blieberger . |
| 3,877,610 | 4/1975 | Dickey . |
| 3,951,308 | 4/1976 | Thirtle . |
| 3,996,402 | 12/1976 | Sindt . |
| 4,032,046 | 6/1977 | Elliott et al. . |
| 4,059,204 | 11/1977 | Duncan et al. . |
| 4,067,481 | 1/1978 | Feldman . |
| 4,124,163 | 11/1978 | Siegmann . |
| 4,144,913 | 3/1979 | Akers et al. . |
| 4,289,257 | 9/1981 | Herb et al. . |
| 4,335,677 | 6/1982 | Nagata et al. . |

(List continued on next page.)

FOREIGN PATENT DOCUMENTS 0363124 4/1990 (EP) .

*Primary Examiner*—Philippe Derakshani
(74) *Attorney, Agent, or Firm*—James E. Bradley; Bracewell & Patterson

(57) ABSTRACT

A dispenser heats and dispenses a melted material through an orifice. A pusher is slidably received within an interior of a cylindrical body of the dispenser and is movable relative to the forward end of the cylindrical body. The pusher is made up of an internally threaded cylinder that receives a driver screw and engages a stick of meltable material. The pusher is used to advance the meltable material toward the forward end of the body. The pusher retracts when the meltable material is exhausted. An induction heated system has a susceptor plate with apertures that lead to the nozzle. In use, the motor automatically retracts the pusher a slight increment when the motor is turned off, which relieves static pressure on the elastic zone of the stick. A PC board has a control circuit to control the advancing and retracting of the pusher and for controlling the temperature of the inductor by regulating the flow of power to the inductor.

17 Claims, 4 Drawing Sheets

U.S. PATENT DOCUMENTS

| | | | |
|---|---|---|---|
| 4,394,967 | | 7/1983 | Amiaut . |
| 4,457,457 | | 7/1984 | Dziki . |
| 4,463,877 | | 8/1984 | Siwon . |
| 4,478,669 | | 10/1984 | Zeller et al. . |
| 4,546,923 | | 10/1985 | II . |
| 4,560,849 | | 12/1985 | Migliori et al. . |
| 4,590,347 | | 5/1986 | Thatcher et al. . |
| 4,601,597 | | 7/1986 | Bertram et al. . |
| 4,642,158 | | 2/1987 | Steinel et al. . |
| 4,669,651 | | 6/1987 | Shaw et al. . |
| 4,669,661 | | 6/1987 | Otto . |
| 4,785,996 | | 11/1988 | Ziecker et al. . |
| 4,938,388 | | 7/1990 | Yeh . |
| 4,953,755 | * | 9/1990 | Dennison ..... 222/146.5 |
| 4,969,602 | | 11/1990 | Scholl . |
| 5,020,723 | | 6/1991 | Crist . |
| 5,050,776 | | 9/1991 | Rosenplanter . |
| 5,101,086 | | 3/1992 | Dion et al. . |
| 5,102,484 | | 4/1992 | Allen et al. . |
| 5,375,766 | | 12/1994 | Sweeney . |
| 5,584,419 | | 12/1996 | Lasko . |

* cited by examiner

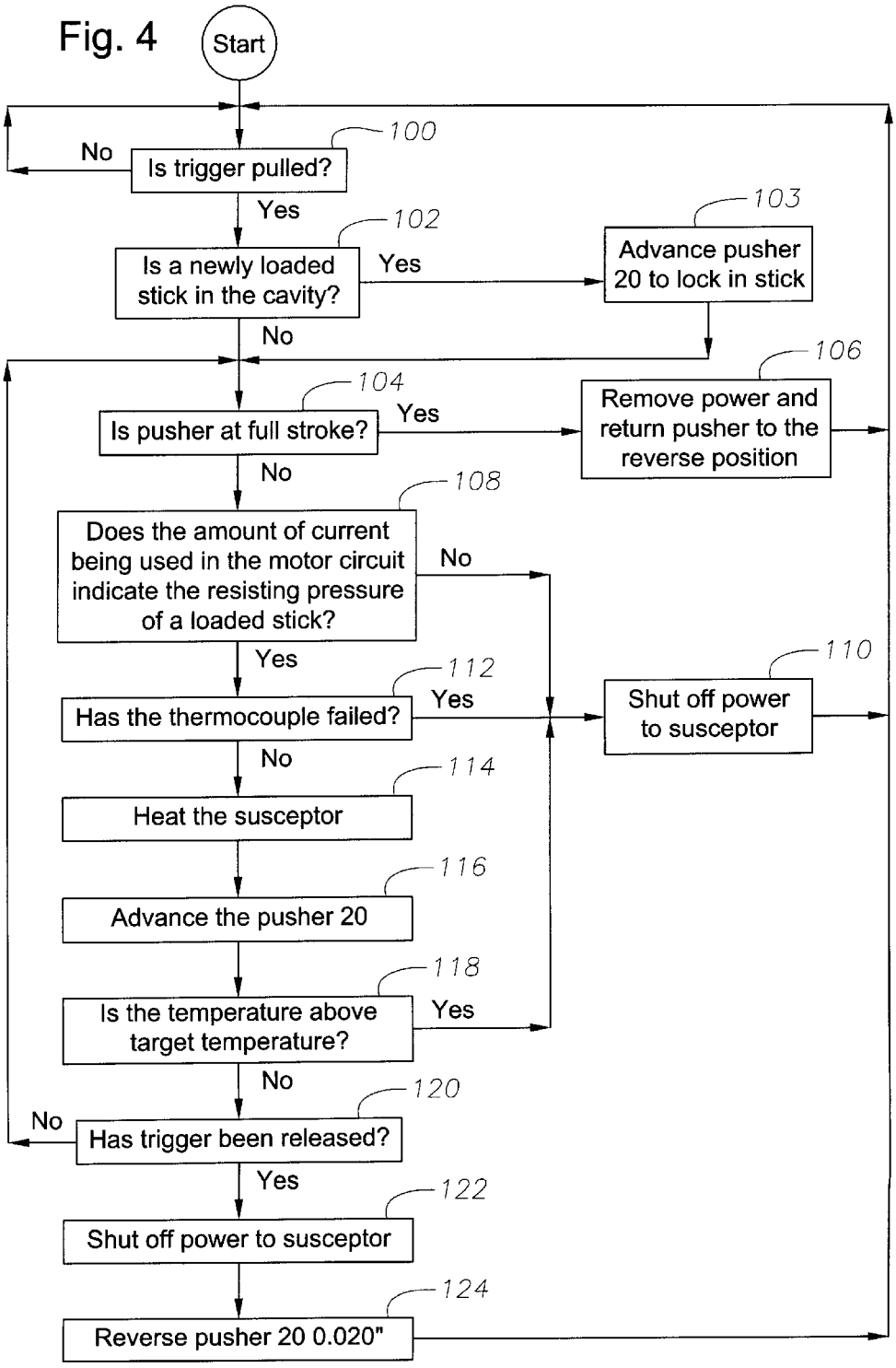
Fig. 4
Start
100
Is trigger pulled?
No
Yes
102
Is a newly loaded stick in the cavity?
Yes
103
Advance pusher 20 to lock in stick
No
104
Is pusher at full stroke?
Yes
106
Remove power and return pusher to the reverse position
No
108
Does the amount of current being used in the motor circuit indicate the resisting pressure of a loaded stick?
No
Yes
112
Has the thermocouple failed?
Yes
110
Shut off power to susceptor
No
114
Heat the susceptor
116
Advance the pusher 20
118
Is the temperature above target temperature?
Yes
No
120
Has trigger been released?
No
Yes
122
Shut off power to susceptor
124
Reverse pusher 20 0.020"

CONTROL SYSTEM FOR GLUE GUN

CROSS-REFERENCE TO RELATED APPLICATIONS

This application claims the benefits of provisional application serial No. 60/104,365, filed Oct. 15, 1998, in the United States Patent & Trademark Office.

TECHNICAL FIELD

A method and apparatus for delivering melted material. More particularly, the apparatus is a glue gun utilizing a method of delivery of molten glue without unwanted drips and at a controlled temperature.

BACKGROUND OF THE INVENTION

Prior art devices have been utilized for heating and dispensing materials, such as for heating a solid material until it melts and then dispensing the material as a liquid. For example, hot glue guns are used for heating an end of a solid glue stick to a transition temperature at which the glue is liquified and then dispensing the melted glue through a dispensing orifice. Typically, a housing is provided having an interior flow path through which the material is pushed as it is heated. Resistance heating elements are commonly used. The resistance heating elements have been mounted to the housing outside of the flow path, and often outside of the housing.

Other devices have utilized induction heating to heat materials for dispensing. A housing is usually provided having an interior flow path through which the material is pushed as it is heated. An electromagnetically heated susceptor is located either directly in or immediately adjacent to the material flow path. Induction coils have been mounted outside of the housing for inducing eddy currents to flow within the susceptors to generate heat for transferring to the materials. Often an external shroud is provided around the induction coil to protect an operator.

A difficulty with prior devices is that once the meltable materials have been melted and dispensed, it is difficult to cease flow of the meltable material without additional and unwanted drips emerging from the nozzle. The additional flow is partially due to a large orifice in the nozzle and to an area of high pressure resulting from compression of the meltable material from the pusher used to force a material towards the heating elements.

SUMMARY OF THE INVENTION

A method and apparatus are provided for heating and dispensing a melted material. A glue gun has a cylindrical body with a trigger mechanism provided on an under side of the body. A motor is located in the interior of the body at a rearward end of the cylindrical body. A gear head is operatively connected to a forward end of the motor. An externally threaded driver screw is rotationally connected to the gear head. A pusher is slidably received within the interior of the cylindrical body and is movable relative to the forward end of the cylindrical body. The pusher is made up of an internally threaded cylinder that receives the driver screw and has an end surface on its forward end that engages a meltable material such as glue, preferably in stick form. The pusher is used to advance the meltable material toward the forward end of the body. The pusher retracts when the a stroke limit of the pusher is reached and the meltable material is substantially exhausted.

A nose assembly is positioned on the forward end of the cylindrical body and is made up of a conical housing, a conical inductor, a conical susceptor, and a nozzle positioned within a central orifice of each of the conical members of the nose assembly. The inductor is preferably a coil that surrounds the susceptor for heating the susceptor. The nozzle permits a flow of a meltable material through a plurality of peripheral passages. The peripheral passages are sized to permit a flow of meltable material under pressure but not to permit a flow of material when not under pressure.

The induction heated system of the invention is dripless and operates without a valve for several reasons. A main reason is that the motor automatically retracts the pusher a slight increment when the motor is turned off, which relieves static pressure on the elastic zone. The expansion of the compressed zone moves the stick back instead of pushing liquid material downstream. Second, the initial start up heat mass is maintained to be as low as possible to shorten the time from trigger pull to material delivery, preferably less than two seconds. Third, the latent heat mass is minimized to diminish "off" cycle melting at the stick melt phase.

An electrical cable connects the inductor with a power source. A PC board has a control circuit to control the advancing and retracting of the pusher and for controlling the temperature of the inductor by regulating the flow of power to the inductor.

The control circuit also automatically detects whether a newly loaded stick of meltable material, such as glue, is positioned within the cavity of the cylindrical body. If so, the pusher is advanced to lock the stick in the cavity. The control circuit will allow full retraction of the pusher only after the chamber is empty or when the pusher is at full stroke. The control circuit automatically detects when the pusher is at full stroke and ceases delivery of power to the inductor and returns the pusher to the reload position. Additionally, the control circuit is designed to determine whether an amount of current is being used that indicates a resistance to pusher movement provided by a loaded stick and whether the thermocouple is in operation. If either of these conditions is not satisfied, then power is automatically shut off to the inductor. Otherwise, the inductor is heated and the pusher is advanced to force liquid meltable material out of the nozzle. If the temperature of the inductor is above a target temperature, then power will be shut off to the inductor and cycled on and off to maintain the approximate target temperature. When the trigger is released, power is shut off to the inductor and the pusher is retracted a slight increment to relieve static pressure on the elastic zone.

BRIEF DESCRIPTION OF THE DRAWINGS

FIG. 4 is a flow diagram of the logic associated with the method of operation of the glue gun of the invention.

DETAILED DESCRIPTION OF THE PREFERRED EMBODIMENT

Figure 1:
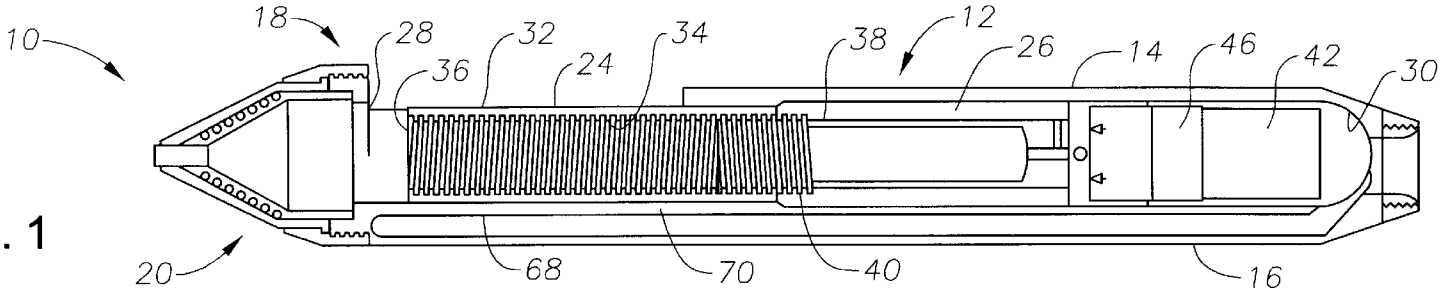
FIG. 1 is a side cross-sectional view of a glue gun of the invention, wherein the pusher is partially advanced.
Figure 2:
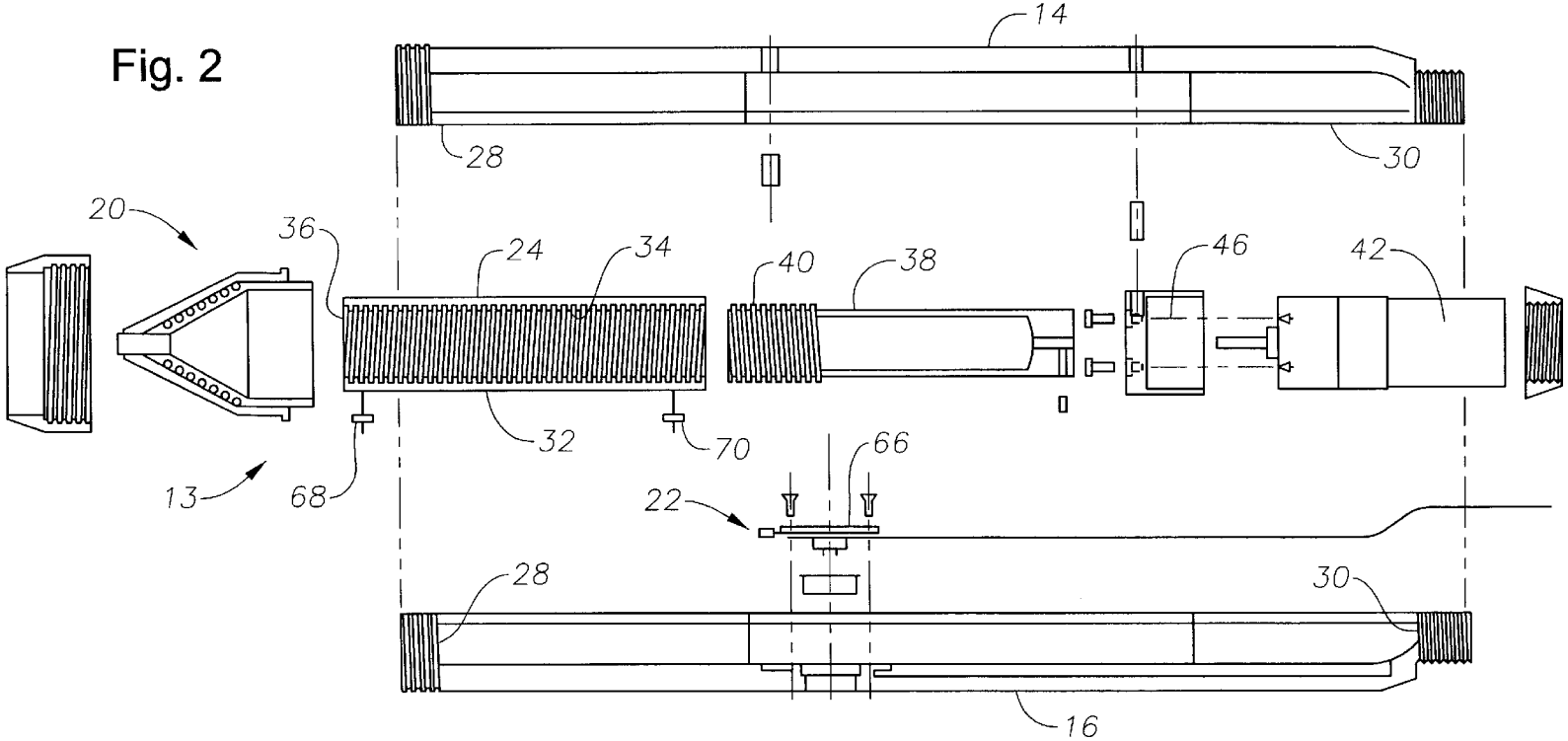
FIG. 2 is an exploded cross-sectional view of the glue gun of FIG. 1.
Figure 3:
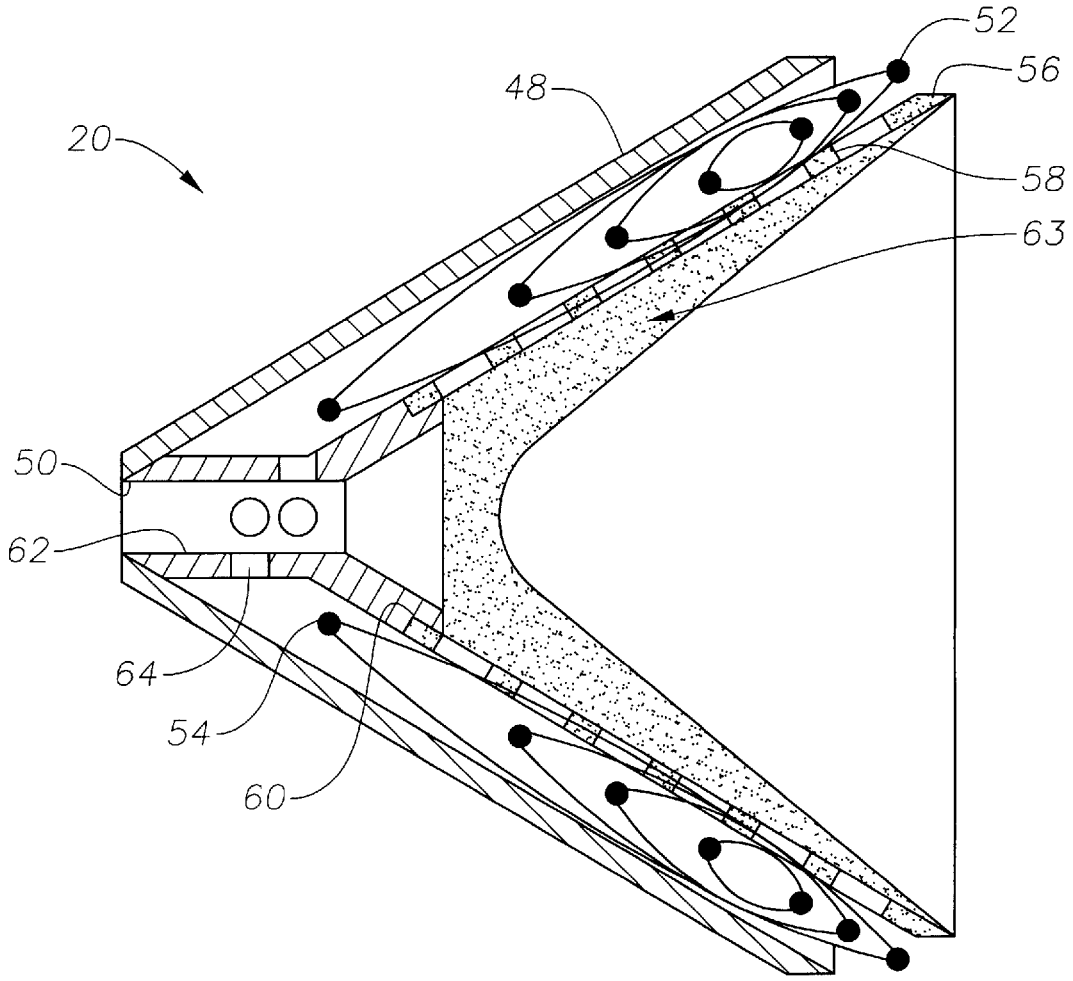
FIG. 3 is an enlarged cross-sectional view of the nose assembly of the glue gun of FIGS. 1 and 2.
Figure 5:
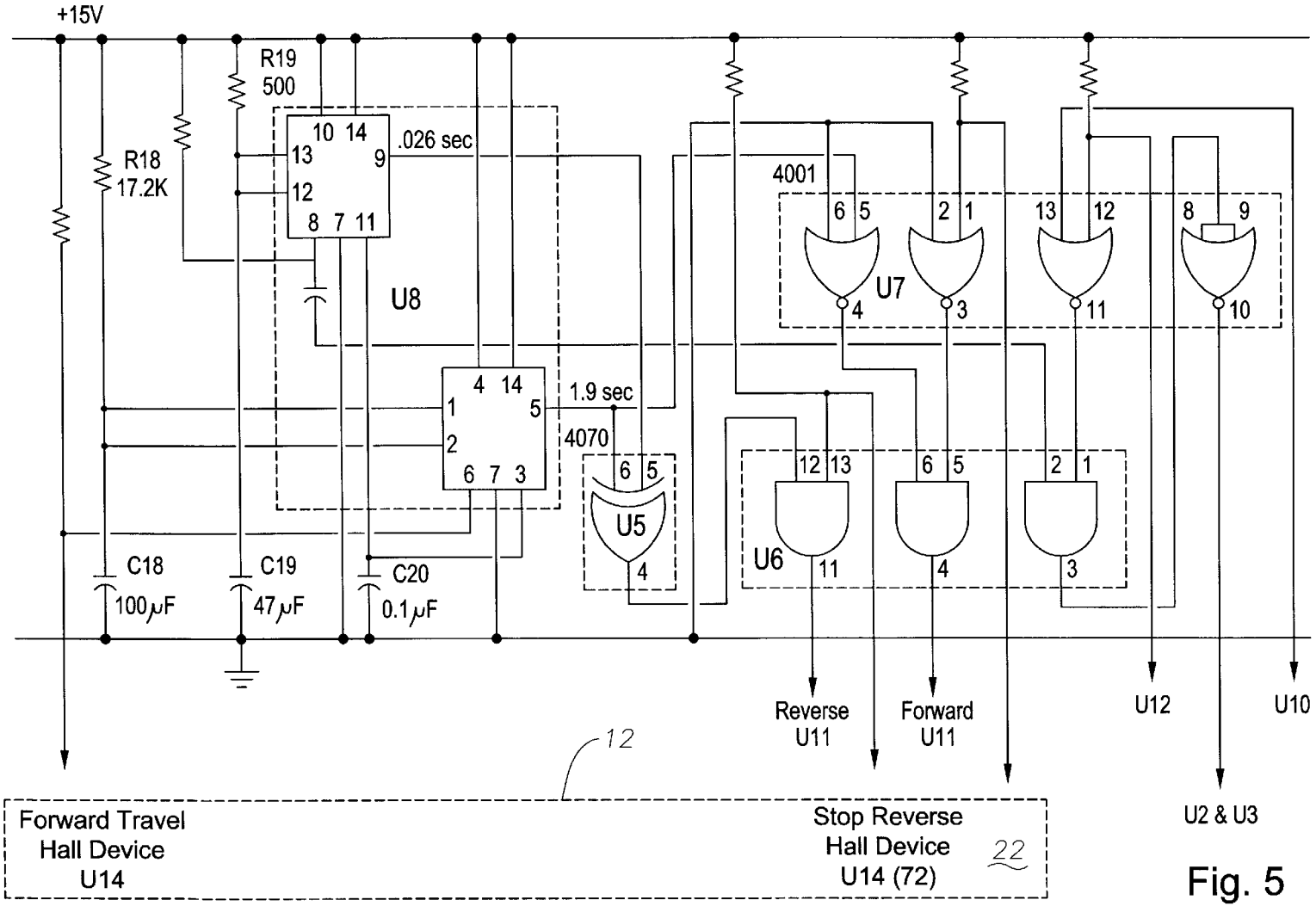
FIG. 5 is a schematic diagram of circuitry used to control the glue gun of the invention.

Referring now to FIGS. 1–3, a glue gun designated generally 10, is shown. Glue gun 10 is used for heating, liquefying and dispensing meltable material, preferably solid sticks of glue that typically measure one inch in diameter and three inches in length. Glue gun 10 has a body 12, which is preferably approximately cylindrical in shape and is made up of a top half 14 and a bottom half 16. Body 12 has a forward end 18 and a nose assembly 20. A trigger mechanism 22 controls heating and dispensing of the hot glue. A power cord extends from body 12 and connects to a power supply (not shown), which is preferably a 110 volt AC power source. Power is preferably controlled by a power supply PC board (FIG. 5).

Pusher 24 provides a means for pushing a glue stick towards nose assembly 20. Pusher 24 is slidably received within an interior cavity 26 of body 12 and has a forward end 28 and a rearward end 30. When the pusher 24 is fully retracted, cavity 26 is accessible for loading a glue stick or other meltable material (not shown). The pusher 24 is made up of an internally threaded cylinder 32 having internal threads 34 and an end surface 36 for engaging a meltable material and advancing the meltable material toward the nose assembly 20. The pusher 24 is advanced and retracted by an externally threaded driver screw 38, which engages internal threads 34 of internally threaded cylinder 32. Externally threaded driver screw 38 is provided with external threads 40. The externally threaded driver screw 38 is rotated by motor 42, which is preferably a 24 volt electric motor. Motor 42 receives power by a power cord (not shown). Motor 42 is operatively connected to gear head 46, which is affixed to externally threaded driver screw 38.

Nose assembly 20 is affixed to a forward end 18 of body 12 and may be seen in greater detail in FIG. 3. Nose assembly 20 is made up of a conical housing cone 48 having a central orifice 50 formed therein. A conical inductor 52 is received within the conical housing 48, which defines a central orifice 54. Preferably, a low resistance coiled inductor is used for efficiency. A conical susceptor 56 is received within the conical inductor 52 and has a plurality of holes 58 formed therein and defines a central orifice 60. Preferably, susceptor 56 is fabricated from a 22 gage low carbon steel perforated sheet that has a surface area of 3.2 square inches and a weight of 0.130 oz. The high ratio of surface area to weight provides a rapid transfer of energy from the susceptor 56 to the meltable material while minimizing latent heat when energy transfer is stopped. Additionally, the susceptor design speeds the initial flow and successive flow recoveries. In this embodiment, the susceptor 56 is constructed with a secondary element, a steel conical housing 48, designed specifically to contain radio frequency emissions.

A nozzle 62 is positioned within central orifices 50, 54 and 60 to deliver melted material for a user's application. The nozzle 62 is provided with a plurality of peripheral passages 64 that are sized to permit flow of meltable material under pressure, but prevent flow of melted material that is not under pressure. Most flow through the nozzle enters through the peripheral passages 64, since peripheral passages 64 communicate with an area that defines a gap between the susceptor 56 and conical housing cone 48, which contains most of the melted material. Although a small amount of material enters through passage 60, most of the material in this area is not melted enough to reduce the viscosity of the material sufficiently to enable flow into passage 60. The dripless "off" cycle is achieved by first relieving elastic pressure at the melt phase 63 in the upstream or rearward direction, and second by minimizing a volume above the orifice in any gun position. Preferably, the gap between the susceptor 56 and conical housing cone 48 at the apex is approximately 0.060". Thirdly, the dripless "off" cycle is achieved by passing the liquid material through a plurality of small peripheral passages 64 at the entry of the delivery passage in nozzle 62. The aggregate area of peripheral passages 64 needs to exceed the delivery orifice area so that the peripheral passages 64 do not impede the volume delivery at the design pressure resulting from force applied by the pusher 24. The combination of the motor 42 and gear head 46 results in a motor gear head speed/torque combination that provides an adequate force to a 1" diameter stick face to deliver 8#/hr of a specified viscosity material through a perforated susceptor and a variable diameter delivery nozzle. The force on the pusher 24 is not to exceed the ability of the continuous high frequency power available at the melt phase to raise the temperature of the stick to a design point (preferably 400° F.). The force on pusher 24 should also not exceed a level of safety with respect to a possible finger pinch point in the open cavity 26 of the body 12. The peripheral passages 64 need to be small enough in individual size to provide a capillary action for the static liquid hot melt, which typically has a 2,000–6,000 CPS viscosity at the delivery temperature. Preferably, peripheral passages 64 are small holes drilled perpendicular to the nozzle axis.

A power cable is provided in the bottom half 16 of body 12 (FIG. 1) for providing power to inductor 52. A PC board 66 (FIGS. 2 and 5)has electronics for controlling whether power is delivered to motor 42 for controlling the advancing and retracting of pusher 24. PC board 66 also controls whether power is delivered over the power cable for controlling the heating of inductor 52. A load position magnet 68 is provided on a forward end 28 of pusher 24 and a reverse position magnet 70 is provided on a rearward end 30 of pusher 24. A Hall effect sensor 72 (FIGS. 2 and 5) is provided on PC board 66 to detect when load position magnet 68 or reverse position magnet 70 is in a position proximate Hall effect sensor 72 to determine whether pusher 24 is in a fully extended or fully retracted position. Hall effect sensor 72 is a magnetic sensing switch that may be obtained from Allegro Microsystems, Incorporated and available as part number UGN3235K Hall effect sensor 72 directs pusher 24 to advance or retract in accordance with the method of operation described below.

Referring now to FIG. 4, in operation, when an operator pushes trigger mechanism 22, the electronics on PC board 66 of glue gun 10 determine that trigger mechanism 22 is being pushed as represented by step 100. If it is determined that trigger mechanism 22 is being pushed, then a determination is made as to whether a newly loaded stick of meltable material, such as glue, is positioned in cavity 26 as represented by step 102. If so, motor 42 is directed to advance pusher 24 to lock in the glue stick. It is preferable that a newly loaded stick is locked into cavity 26 so that glue gun 10 can be immediately operated in an inverted position without having the glue stick fall out. If it is determined in step 102 that a newly loaded stick is positioned within cavity 26, then pusher 24 is advanced to lock in the glue stick, as represented by box 103. If it is determined in step 102 that a newly loaded stick is not positioned within cavity 26, then a determination is made as to whether pusher 24 is positioned at full stroke, as represented by step 104. If pusher 24 is positioned at full stroke, then the glue stick has been extinguished. Preferably, the glue gun 10 is designed such that a partially expended stick may not be removed from cavity 26. By removing a partially expended stick, hot material at the stick face may cause injury to an operator who is attempting to remove the stick. Additionally, by removing a stick, melted material in cavity 26 will subsequently cool, which may prevent the insertion of additional sticks.

If it is determined in step 104 that the pusher 24 is at full stroke, then power is no longer delivered in power cable 44 so that inductor 52 is no longer being heated. Additionally, motor 42 is directed to retract pusher 24 to the fully retracted or reload position as indicated in step 106. If it is determined that the pusher 24 is not at full stroke in step 104, then a determination is made whether an amount of current being used by motor 42 is indicative of the presence of resisting pressure provided by a loaded stick, as represented in step 108. The presence of a stick in the cavity 26 needs to be sensed on each operation of gun 10 to prevent high frequency power from being delivered in the absence of a continuous load. If power were delivered to inductor 52 in the absence of a stick, then the stick "heel" remaining in the cavity 26 adjacent to susceptor 56 would melt back into cavity 26.

If it is determined that the current being used indicates that a stick is not present, as represented in box 108, then power is shut off to inductor 52 as represented by box 110. If it is determined that a stick is present in step 108, a determination is made as to whether the thermocouple has failed as represented by box 112. If the thermocouple has failed, then power is shut off to inductor 52 as represented by box 110. If the thermocouple is operational, then the glue gun 10 delivers power to heat inductor 52 as represented by box 114. Additionally, power is provided to motor 42 to advance pusher 24 as represented by box 116. A determination is then made whether the temperature of susceptor 56 is above a predetermined target temperature as represented by box 118. The temperature of material at the hottest point of susceptor 56 should not exceed the melt delivery temperature as the nozzle 62 is initially cleared of the frozen plug in the fast start up of the system. If the temperature is above the target temperature, as determined in step 118, then power is shut off to inductor 52 as represented by box 110. The power is subsequently cycled on and off to maintain the temperature at approximately the target temperature as represented by steps 100–118.

If the temperature is not above the target temperature, as determined in step 118, then a determination is made whether trigger mechanism 22 has been released as represented by box 120. If the trigger mechanism 22 is determined not to have been released, then glue gun 10 continues to operate as represented by boxes 104–120. If it is determined in step 120 that the trigger mechanism 22 has been released, then power is shut off to inductor 52 as represented by box 122 and pusher 24 is reversed approximately 0.02 inches to relieve pressure on the material in the elastic zone.

Referring now to FIG. 5, a circuit diagram of a power supply PC board is shown. The timers of dual timer U8 feed an electrical signal to a two input quad X-OR gate U5. Preferably quad X-OR gate U5 is set up such that 1–0=1/0–1=1. The timers of dual timer U8 communicate with quad with X-OR gate U5 to create a positive output to motor controller U11 to switch motor 42 (FIGS. 1 and 2) in reverse for either a predesignated period of time, preferably 0.026 seconds, to relax the stick compression zone after each release of trigger mechanism 22, or 1.9 seconds for a full reversal of pusher 24. Both timers of dual timer U8 are set by changing the timers associated resistor/capacitor combinations. In the preferred embodiment, resistor R19 is a 500 ohm/C19 47 uF set at 0.026 seconds at line U8-9 to relieve pressure. Resistor R18 is preferably set at 17.2K/C18 100 uF=1.9 seconds at line U8-5 for full reversal. The output at line U5-4 is matched with another positive signal in quad AND gate that is taken negative to stop the reverse of motor 42 (FIGS. 1 and 2) when Hall effect switch U14 is actuated by load position magnet 68 (FIGS. 1 and 2). This action stops motor 42 during the timing cycle at the reload position or fully open position prior to a stall at the end of the rack or screw.

When the normally opened trigger mechanism 22 is closed to ground line, U7-1 goes negative and with its permanently negative line U7-2 makes line U7-3 positive. This action does two things. It makes line U6-5 positive and with the normally positive line U6—6 (line U7-5 is not receiving a positive reverse signal from the 1.9 second one shot) makes line U6-4 positive, switching motor controller U11 on for forward travel.

The positive line U7-3 on trigger action also holds line U8—8 positive during forward travel. When trigger mechanism 22 is released, line U7-3 goes negative causing timer output line U8-9 to deliver a 0.026 second pulse positive to line U5—5 making line U5-4 positive to switch motor controller U11 into reverse for 0.026 seconds to relieve the pressure on the compressive solid/liquid interface in the interior cavity 26 (FIGS. 1 and 2).

The Hall effect sensor U14 (FIG. 5) or 72 (FIGS. 1 and 2) is actuated by the reverse position magnet 70 (FIGS. 1 and 2) at the extent of the forward travel of pusher 24. The normally open contact of Hall sensor U14 closes to the ground line, placing a negative signal on line U8-6 which sends a 1.9 second output to U5-6 to initiate a motor controller U11 reverse. It also sends a signal via line U7-5 to interrupt forward travel of pusher 24 if the operator continues to hold trigger mechanism 22 in a closed position by making line U6-4 negative.

If the operator has not released trigger mechanism 22 at the end of the reverse cycle, the unit will cycle forward again without heat and will continue to do so until trigger mechanism 22 is released. Automatic reverse at the full stroke at pusher 24 is the only reverse of glue gun 10. This is designed to make the removal of a partially used stick difficult, since removal of a partially used stick can lead to performance difficulties.

A negative signal from line U7-10 to shut down circuits of the bridge drivers U2 and U3 gates the power bridge to heat susceptor 56 (FIGS. 1 and 2). This action requires a negative signal on line U7-12 reporting that an amount of current is being used in the motor circuit that would indicate the resistance force of a loaded stick. The lack of this signal prevents the melting or softening of the remaining stick heel if a stick is not loaded within chamber interior cavity 26 (FIGS. 1 and 2). It also requires a negative signal from thermoouple controller U10 to the companion input line U7-13. The signal over line U7-13 will oscillate to hold a predetermined susceptor set temperature as the glue stick is advanced by pusher 24 (FIGS. 1 and 2).

These actions are reported as a positive signal to the line U6 AND gate via line U6-1 along with a positive trigger signal over line U6-2. This signal is inverted at U7-8/9/10 to allow the drivers U2 and U3 to gate the power circuit. The release of the trigger mechanism 22, expiration of the stick, exceeding the target temperature of susceptor 56, or failure of the thermocouple U10 will stop the heat.

This invention has several advantages. Dripless operation without a valve is accomplished by providing specially sized peripheral passages. Melted material is only delivered when a specified amount of pressure is experienced by the melted material. Additionally, the automatic retraction of the pusher upon release of the trigger mechanism relieves the pressure and prevents unwanted melting of the glue stick. The combination of the above described mechanical features with the electronic control system of the invention provides dripless automated operation, precise product temperature and improved operator safety.

While the invention has been shown in only one of its forms, it should be apparent to those skilled in the art that it is not so limited, but is susceptible to various changes without departing from the scope of the invention.

What is claimed is:

1. An apparatus for delivering a melted material, comprising:

a body having a nozzle and a cavity for receiving a meltable material;

a heat source located adjacent the nozzle;

an electrically driven drive member in the cavity for forcing the melted material through the heat source and out the nozzle; and an electrical controller that automatically reverses the drive member a selected distance each time power to advance the drive member ceases, so as to relieve pressure on said meltable material to prevent drips.

2. The apparatus for delivering a melted material according to claim 1, wherein:

the drive member is a pusher.

3. The apparatus for delivering a melted material according to claim 1, further comprising:

a manually actuatable switch for selectively supplying power to advance the drive member and wherein the electrical controller detects when said switch is opened.

4. The apparatus for delivering a melted material according to claim 1, wherein:

a heat source is a conductor and a susceptor.

5. The apparatus for delivering a melted material according to claim 1, wherein:

said drive member is a pusher that retracts to a reload position upon elimination of approximately all of said meltable material so that said apparatus may be reloaded with meltable material, said drive member fully advance able to a fully advanced position for delivering approximately all of said meltable material; and said electrical controller prevents retracting of said drive member to reload said meltable material unless said meltable material is substantially eliminated; and further comprising:

a sensor to detect a position of said drive member.

6. An apparatus for delivering a melted material according to claim 1, wherein:

said drive member is a pusher that retracts to a reload position upon elimination of approximately all of said meltable material so that said apparatus may be reloaded with meltable material, said drive member fully advance able to a fully advanced position for delivering approximately all of said meltable material; and said electrical controller automatically retracts said pusher when said sensor detects that said pusher is in a fully advanced position; and further comprising a sensor to detect a position of said drive member.

7. An apparatus for delivering a melted material according to claim 1, wherein:

said drive member is a pusher that retracts to a reload position upon elimination of approximately all of said meltable material so that said apparatus may be reloaded with meltable material, said drive member fully advance able to a fully advanced position for delivering approximately all of said meltable material; and further comprising:

a sensor to detect a position of said drive member; wherein said electrical controller prevents advancing unless said meltable material is present.

8. An apparatus for delivering a melted material comprising:

a body having a nozzle and an internal cavity for receiving a stick of meltable material;

a heat source mounted in said body adjacent said nozzle;

a pusher derivably received within said internal cavity for forcing said stick toward said nozzle, said pusher derivable to and from a reload position to a fully advanced position;

a load position magnet on a first end of said pusher;

a reverse position magnet on a second end of said pusher; and a sensor stationarily mounted in said body to sense said load position magnet when said pusher is in said reload position and to sense said reverse position magnet when said pusher is in said fully advanced position.

9. An apparatus for delivering a melted material, according to claim 8, further comprising:

an electrical controller that prevents retracting of said pusher member to reload said meltable material unless said meltable material is substantially eliminated, said electrical controller automatically retracts said pusher when said sensor detects that said pusher is in a fully advanced position and prevents advancing of said pusher unless said meltable material is present; and wherein:

said sensor detects a position of said drive member, whereby the presence of meltable material is determined; wherein said electrical controller prevents advancing of said pusher unless the presence of meltable material is detected.

10. A method of reducing drips of a melted material from a dispenser, after it has been turned off, the dispenser having a cavity for receiving a meltable material, a nozzle, a heat source adjacent the nozzle and an electrically driven drive member that forces the meltable material through the heat source and out the body, the method comprising:

determining whether power to advance said drive member has ceased, and, if so, automatically reversing said drive member a selected distance to relieve pressure from said drive member on said meltable material.

11. The method according to claim 10, wherein:

said drive member is a pusher, wherein said meltable material is a stick; and further comprising the steps of:

forcing said meltable material against a heat source with said pusher wherein said heat source has apertures through which melted material flows;

advancing said pusher to a fully advanced position so that substantially all said meltable material is eliminated; and retracting said pusher to a reload position when said meltable material is eliminated so that new meltable material may be loaded into said cavity.

12. The method according to claim 11, further comprising the steps of:

automatically retracting said pusher to said reload position when said stick of meltable material is substantially extinguished; and preventing said pusher from moving to said reload position unless said stick is substantially extinguished to prevent an operator from removing a partially used stick of material.

13. The method according to claim 11, further comprising the steps of:

sensing when said pusher is in a fully advanced position, which indicates when said stick of meltable material is substantially eliminated; and automatically retracting said pusher to said reload position when said pusher is in a fully advanced position.

14. The method according to claim 11, further comprising the steps of:

retracting said pusher to said reload position;

sensing whether said stick of meltable material has been loaded in an internal cavity when said pusher is in said reload position; and preventing said pusher from advancing toward said nozzle unless a stick of meltable material has been located in said internal cavity.

15. A method of delivering a melted material comprising the steps of:

providing a dispenser with a cavity, a nozzle, an electrically driven pusher, a heat source adjacent the nozzle, and a control circuit having a switch for supplying power to the heat source and to the pusher;

inserting a stick of meltable material in said cavity;

closing said switch to heat the heat source and to advance the pusher to force the stick of meltable material into contact with said heat source to create melted material that flows out said nozzle; then once a quantity of said melted material has been dispensed, opening said switch; and removing power to said heat source, causing the control circuit to automatically retract said pusher a distance to relieve pressure on said stick to eliminate unwanted drips.

16. The method according to claim 15 wherein:

said control circuit automatically retracts said pusher to remove said stick from contact with said heat source when the switch is opened.

17. The method according to claim 15, further comprising the steps of:

determining whether said stick is located within said internal cavity when said switch is closed; and shutting off power to said heat source and said pusher if said stick is not present.

* * * * *